US005807073A

United States Patent [19]

Jensen et al.

[11] Patent Number: 5,807,073

[45] Date of Patent: Sep. 15, 1998

[54] INLINE CENTRIFUGAL PUMP

[75] Inventors: Niels Due Jensen; Bjarne Larsen, both of Bjerringbro, Denmark

[73] Assignee: Grundfos a/s, Bjerringbro, Denmark

[21] Appl. No.: 790,511

[22] Filed: Jan. 29, 1997

[30] Foreign Application Priority Data

Jan. 31, 1996 [DE] Germany ..... 196 03 337.3

[51] Int. Cl.[6] ..... F04D 29/42

[52] U.S. Cl. ..... 415/206; 415/203

[58] Field of Search ..... 415/182.1, 203, 415/204, 205, 206

[56] References Cited

U.S. PATENT DOCUMENTS 1,934,013 11/1933 Sims ..... 415/204
3,910,715 10/1975 Yedidiah .

FOREIGN PATENT DOCUMENTS 3-011888 1/1981 Germany .
821609 10/1959 United Kingdom .
2165888 4/1986 United Kingdom ..... 415/206

OTHER PUBLICATIONS

"Radial–Und Axialpumpen Theorie, Entworf, Anwendung", vin A. J. Stephanoff, Springer–Verlag, 1959.

*Primary Examiner*—Christopher Verdier
*Attorney, Agent, or Firm*—Jacox, Meckstroth & Jenkins

[57] ABSTRACT

An inline centrifugal pump comprising a radial or semiaxial impeller. The rotational axis of the impeller is perpendicular to the flow axis of the connection pieces. A suction channel leading from the suction connection of the pump housing to the suction mouth of the impeller comprises, in the turning region, a conically tapering section which runs towards the suction mouth of the impeller. In this manner the efficiency of the pump can be improved.

7 Claims, 2 Drawing Sheets

INLINE CENTRIFUGAL PUMP

BACKGROUND OF THE INVENTION

The invention relates to an inline centrifugal pump.

Pumps whose suction and pressure connection pieces are arranged on the same axis are called inline centrifugal pumps. With most inline centrifugal pumps having a radial impeller, the rotational axis of the impeller is perpendicular to the common axis of the connection pieces, so that the flow is turned about approximately 90° before entry into the impeller. The subsequent description is directed towards this type of pump.

It is known that each change in direction in the flow channels produces losses, changes the flow profile and can also produce swirl in the fluid. With a non-uniform flow profile in the suction mouth of the impeller, the impeller channels are not uniformly loaded, by which means the efficiency of the pump decreases, the maintaining pressure level increases and the unit does not run smoothly but noisily. Because of this, from the design point of view, one is constantly concerned with forming the suction side of the pump housing such that any influences of the suction line are largely done away with, and that the fluid with as uniform as possible flow profile enters the impeller.

The flow channel on the suction side, from the intake connection of the pump housing up to the suction mouth of the impeller, can be divided into three sections: a first one which guides the fluid radially in the direction of the impeller axis, a second one in which the change in direction, i.e. the turning about approximately 90° is effected and a third one which leads the fluid axially to the impeller. These suction channel sections are more or less strongly demarcated and also have differing cross section ratios along the path of flow.

In the literature (for example A. J. Stephanoff, Theory, Design, Application of Radial and Axial Pumps, German translation of the second edition by Dr. Ing. Alexander Haltmeyer, Springer-Verlag Berlin/Göttingen/Heidelberg 1959), a suction tube arranged coaxially to the impeller axis and running conically towards the suction mouth is described as optimal for the flow engineering. If this suction tube must then formed as a suction bend, as is a design contraint with inline pumps, there results therefrom a tapered bend with, if possible not too small a radius of bending. Such an arrangement is regarded just as hydraulically good, at least with small specific rotational speeds. Modern pump design must however be as compact as possible, i.e. the constructional height of the pump must be minimized, which contradicts the previously described tapered bend. In order to minimize the constructional height, there has been developed a suction bend variation with which the turning of the fluid from the radial direction to the direction of the impeller axis is effected within a spiral shaped housing section which laterally surrounds the impeller. Whilst in the region of small specific rotational speeds, a comparatively good hydraulic efficiency is still achieved with this constructional shape, this efficiency is worsened with increased larger specific rotational speeds. This is probably due to the fact that the turning of the flow twice directly in front of the impeller entry leads to swirl and thus to losses. Furthermore with this constructional shape, an acceleration of the flow by reduction in cross section directly in front of the impeller for levelling the speed profile of the flow is only possible under certain very restricted circumstances. The turning region here is then formed as a channel running spiral shaped and linking the flow to the suction mouth.

BRIEF SUMMARY OF THE INVENTION

It is an object of the present invention to so further design a housing for an inline centrifugal pump, that the fluid is led to the impeller with as small as possible losses and with a uniform as possible speed profile, and that the constructional size of the pump unit, measured in the direction of the impeller axis, is kept as small as possible, in order to, in this way, achieve an increase in efficiency in spite of a small constructional height. Thus a flow channel on the suction side is to be created which unifies the advantages of both previously mentioned constructional forms, but avoids their disadvantages.

According to the invention, this object is achieved by providing a pump in which a rotational axis of the impeller is arranged perpendicular to a flow axis of the pump, the pump defining a suction channel comprising a turning region comprising a conical section which defines a conical shaped inner form runs tapering towards a suction mouth, wherein the suction channel comprises a part which runs essentially perpendicular to the impeller axis and opens generally radially into the conical section.

The invention thus provides for the suction channel in the turning region to be so designed that a section tapering conically, preferably tapering conically truncated, to the suction mouth of the impeller is created and into which the part of the suction channel running perpendicular to the impeller axis approximately radially opens. With this, the radial channel part intersects the conical section such that at least a wall part with a part-conical inner form remains. This would be the wall part lying opposite the opening region of the radial channel part. The conical section running to the suction mouth of the impeller, which forms the turning region for the flow, provides for an extensive levelling of the flow profile and is designed as an acceleration stretch in accordance with the resulting reduction in cross section towards the impeller. By way of this design according to the invention, the efficiency of the pump is increased, this being largely independent of the flow profile present at the connection piece, i.e. independent of the site.

It is particularly advantageous when the turning region is formed as a section tapering in a conically truncated manner towards the suction mouth of the impeller. It may however be a cone shaped section, i.e. this section must not neccesarily be rotationally symmetrical, and the angle of inclination $\alpha$ must not be necessarily constant, although this is of course advantageous. Cone shaped in the sense of the invention may also be a trumpet type shape.

With particularly bad flow situations, by installing a rib, known per se, parallel to the direction of flow in the suction channel, any occuring swirl of the flow may be reduced. If the pump is first and foremost driven in the part load region, then it is advantageous to incorporate a stabilizing body in the middle of the axial part. As a rule however, these measures would not be required, so that the design according to the invention alone already creates a noticeable increase in the efficiency of the pump.

It is particularly advantageous when the suction channel, from its circular cross section in the region of the suction connection, blends into an essentially trapezoidal, and in the corner regions, rounded cross section which opens approximately radially into the conical turning region. With this, the cross sectional shape of the channel directly in front of the opening in the turning region essentially corresponds to the longitudinal section of the conically tapering section. In this manner, the channel blends into the conical section over its whole length and this preferably such a way that the channel, with its lateral wall, which forms the longer base of the trapezoidal cross section, lies flush with the floor of the turning region, and that the lateral walls of the channel in the longitudinal section plane in which the impeller axis lies, blends into the conical wall part of the turning region. Thus the imaginary extensions (seen in the direction of flow) of the lateral walls of the channel, on intersection with the truncated cone shaped wall part of the turning region, are arranged perpendicularly on a longitudinal section plane, in which the axis of the impeller lies.

There results particularly good flow conditions when the ratio of the cross sectional area of the suction channel in the region directly in front of the turning region, to the cross sectional area of the suction channel in the region of the suction connection lies between 0.8 and 1.4. At the same time the largest cross sectional area of the suction channel in the turning region transverse to the axis of the impeller should have the following ratio to the cross sectional area in the cylindrical section of the suction channel in the region directly in front of the suction mouth of the impeller.

$$0.5 \leqq \frac{\sqrt{D}}{\sqrt{C}} \leqq 0.8,$$

Finally the height of the conical turning region should be larger than the height of the suction channel directly in front of the conical turning region plus the smallest radius of curvature in this transition region, whereby the smallest radius of curvature corresponds to 0.2 to 0.5 times the radius of the suction channel cross section in the connection piece.

The acute angle of inclination $\alpha$ of the conical section of the suction channel may be in the region between 10° and 25°, preferably an approximately constant 15°.

BRIEF DESCRIPTION OF THE DRAWINGS

The invention is hereinafter described in more detail by way of one embodiment shown in the drawings. These show.

DETAILED DESCRIPTION OF THE PREFERRED EMBODIMENT

Figure 1:
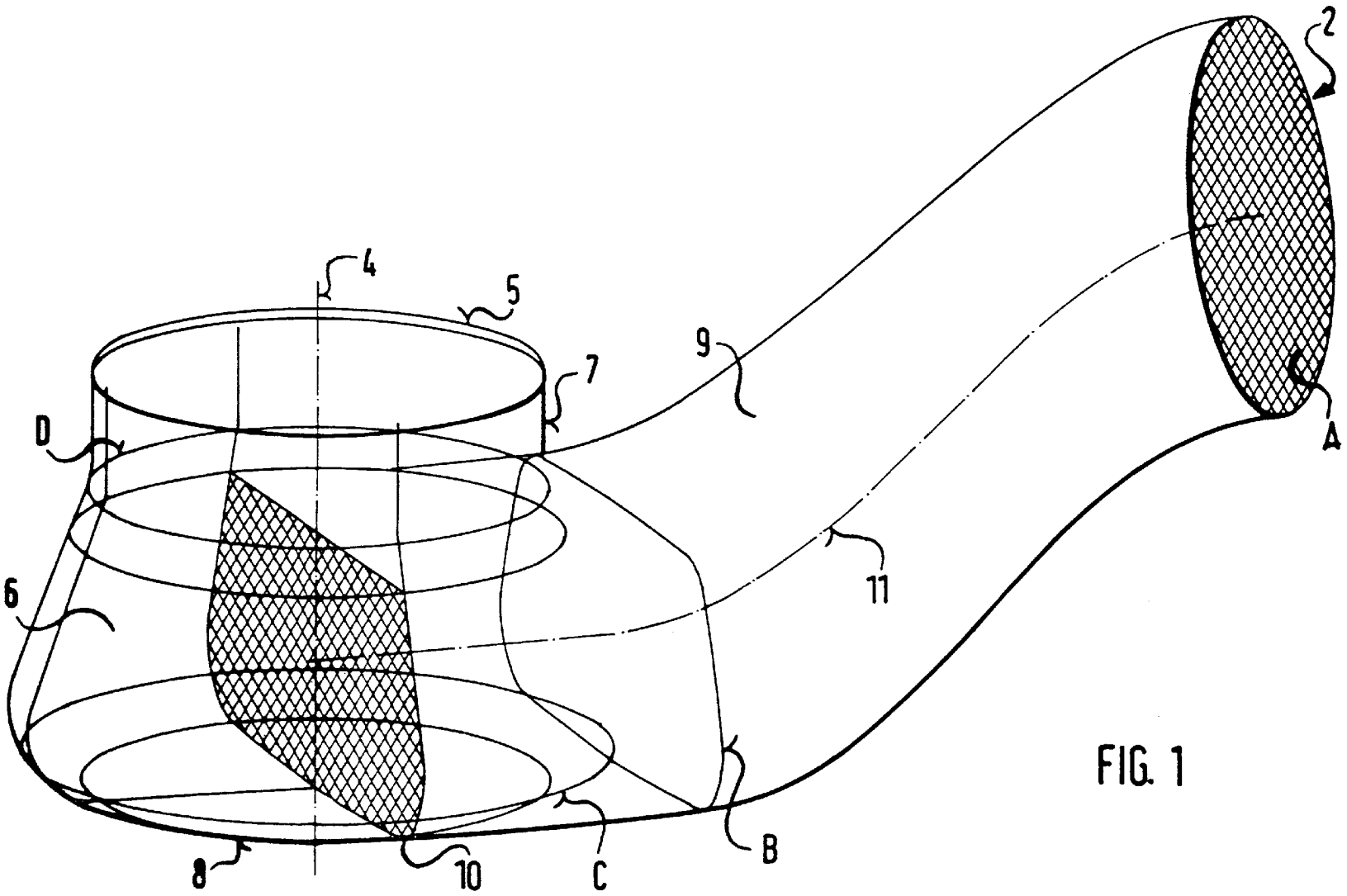
FIG. 1 a perspective schematic representation of the suction channel, of an inline centrifugal pump, between the connection piece and the suction mouth of the impeller, FIG. 2 an axial section through a pump housing with cross sectional representations of the suction channel shown in FIGS. 3–6.

The suction channel represented in the figures has a shape roughly similar to the head of a pipe. Its position is shown clearly by way of FIG. 2, which shows a longitudinal section through the pump housing 1. With this, the connection on the suction side (suction connection piece) is indicated at 2 and the connection on the pressure side (pressure connection piece) is indicated at 3. As the drawing makes clear, the suction and connection pressure pieces 2, 3 are on the same axis, as is usually the case with inline pumps.

Figure 2:
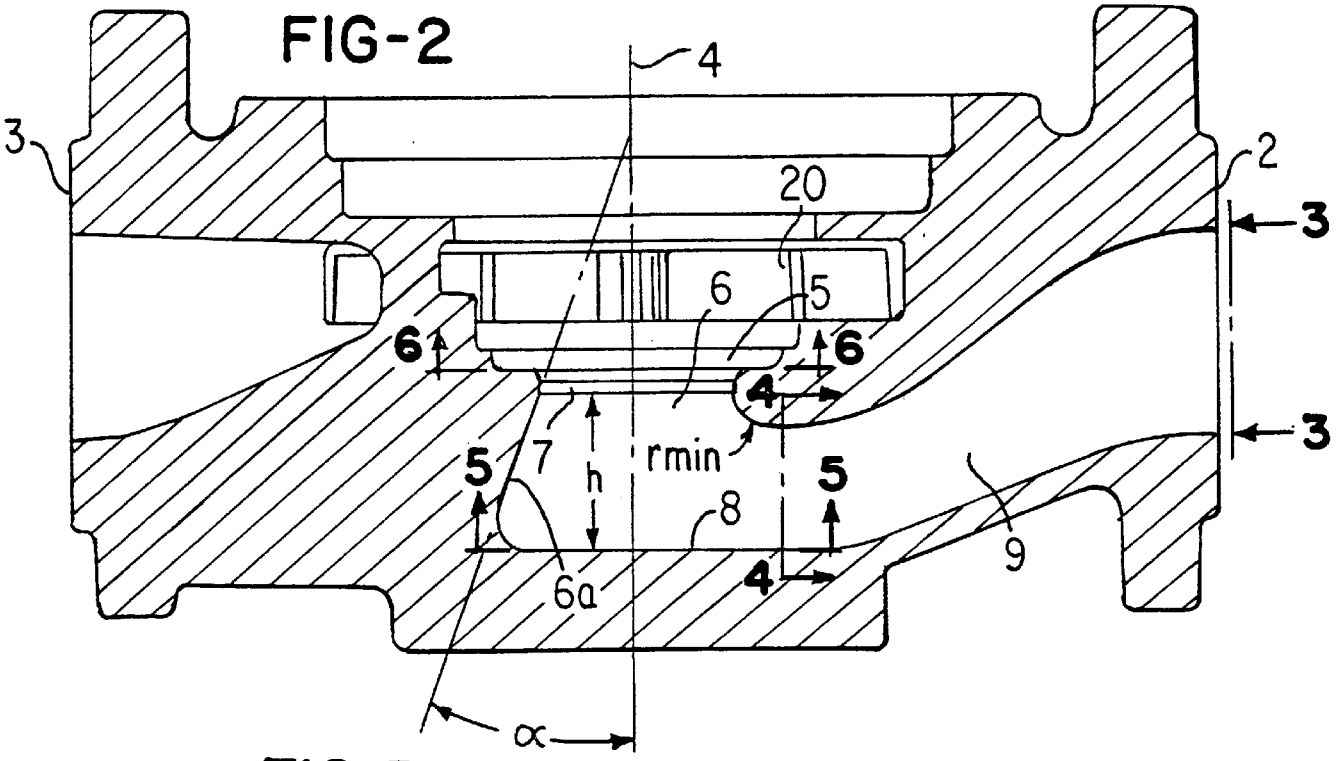
Figure 3:
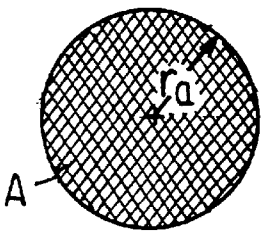
FIG. 3 is a cross-sectional, fragmentary view of the pump, taken in the direction 3—3 in FIG. 2, illustrating an area A.
Figure 4:
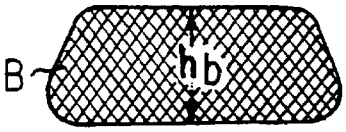
FIG. 4 is a cross-sectional, fragmentary view of the pump, taken in the plane 4—4 in FIG. 2, illustrating an area B.

As the cross sectional representation, indicated in FIG. 3 at A, of the channel in the region of the suction connection piece 2 (FIG. 2) makes clear, the channel is circular and comprises a radius $r_a$. From the suction connection piece 2, the channel runs with its radial part 9, which is essentially perpendicular to an impeller axis 4, firstly essentially radially to the rotational axis 4 of an impeller 20 and, underneath the impeller, meets with the axial channel section in front of the impeller 20. With this, the cross sectional contour of the channel changes along the channel axis 11 from the circular cross section A of the suction connection piece 2 to a trapezoidal cross section with distinctly rounded corners. This trapezoidal cross section is given the reference B in FIG. 4. Notice that the trapezoidal cross-section is formed by walls 1*a* and 1*b* and a floor 1*c*, all of which run parallel to the channel axis 11. Here the flow is led roughly perpendicular to the impeller axis 4 (FIG. 2). With its trapezoidal cross section B, the suction channel opens into a section 6 which tapers with a truncated cone shape towards the suction mouth 5 of the impeller 20 and which forms the turning region for the flow. In the turning region 6, the arriving flow is turned around from a previously radial direction to a direction parallel to the axis 4 and is accelerated by the tapering of the cross section in the section 6 towards the suction mouth 5.

The flow then charges the impeller 20, leaves the impeller 20 and reaches the pressure connection piece 3 via the spiral housing known per se.

Figure 5:
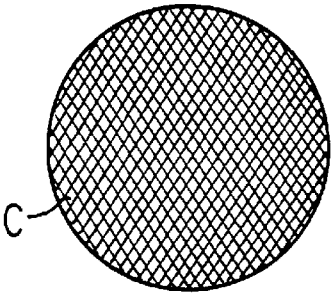
FIG. 5 is a cross-sectional, fragmentary view of the pump, taken in the plane 5—5 in FIG. 2, illustrating an area C.

As can be seen by way of the figures, there is a cylindrical section 7 between the truncated cone shaped section 6 and the suction mouth 5. As can be deduced from FIG. 2, the suction channel opens in the region of its trapezoidal cross section B (FIG. 4) in a manner such that its lower lateral wall (in the figures), which forms the longer base of the trapezoidal cross-section, lies flush with the floor of the turning region 6 (FIG. 2), and the lateral walls of the channel in the longitudinal section plane 10 in which the impeller axis 4 lies, blend into a conical wall part 6*a* of the turning region 6. This longer base of the trapezoid cross section thus blends into an end wall 8 facing the impeller. In this region, the turning region 6 comprises its largest cross section, this is referred to at C in FIG. 5. Since the channel cross section B (FIG. 4) in the opening region between the radial channel part 9 (FIG. 2) and the truncated cone shaped section 6 corresponds to the inner contour of the truncated cone shaped section 6 resulting in this region in the longitudinal section along the impeller axis 4, the wall of the section 6 in the region lying opposite the opening is only formed part truncated cone shaped, there thus results an essentially half truncated cone shaped wall part. Only in the region of the transition radius $r_{min}$ does the truncated cone shape extend over almost the whole periphery.

Figure 6:
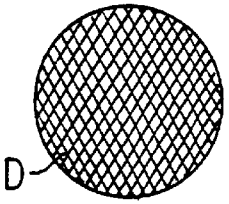
FIG. 6 is a cross-sectional, fragmentary view of the pump, taken in the plane 6—6 in FIG. 2, illustrating an area D.

The length of the truncated cone shaped section 6, seen in the direction of the axis 4 of the impeller 20 results from the height $h_b$ of the suction channel directly in front of the entry into the turning region 6, plus the smallest radius $r_{min}$ (FIG. 2) in with which the shorter base lying opposite the end wall, of the trapezoid cross section, blends into the lateral wall of the truncated cone shaped section 6 directly in front of the suction mouth 5. With the embodiment form shown, this radius $r_{min}$ is so chosen that it corresponds to approximately one third of the radius $r_a$ (FIG. 3) of the suction channel in the region of the suction connection piece 2. The acute angle of inclination $\alpha$ (FIG. 2) of the suction channel wall in the region of the truncated cone shaped section 6, with respect to the impeller axis 4, i.e. the gradient of the trucated cone, is about $10° \leqq \alpha \leqq 25°$, and in the illustration being described is about 22° in the embodiment shown. The ratio of the cross sectional areas B (FIG. 4) to A (FIG. 3) is greater than or equal to 0.8 and less than or equal to 1.4. In the illustration being described, the ratio is about 0.82. It should also be appreciated that the ratios of the square roots of the cross section areas D (FIG. 6) and C (FIG. 5) result in a ratio of 0.7 in the illustration being described.

We claim:

1. An inline centrifugal pump with a radial or semiaxial impeller, in which a rotational axis of the impeller is arranged perpendicular to a flow axis of the pump, said pump defining a suction channel comprising a turning region comprising a conical section which defines a conical shaped inner form which tapers towards a suction mouth, wherein the suction channel comprises a portion which runs essentially perpendicular to said impeller axis and opens generally radially into said conical section.

2. The centrifugal pump according to claim 1, characterized in that the conical section of the suction channel comprises a constant angle of inclination α which lies in the following region $$10° \leqq \alpha \leqq 25°.$$

3. An inline centrifugal pump with a radial or semiaxial impeller, in which a rotational axis of the impeller is arranged perpendicular to a flow axis of the pump, said pump defining a suction channel comprising a turning region comprising a conical section which defines a conical shaped inner portion which tapers towards a suction mouth, wherein the suction channel comprises a portion which runs essentially perpendicular to said impeller axis and opens generally radially into said conical section;

characterized in that the suction channel defines a trapezoidal area which opens substantially radially into the conical turning region.

4. An inline centrifugal pump with a radial or semiaxial impeller, in which a rotational axis of the impeller is arranged perpendicular to a flow axis of the pump, said pump defining a suction channel comprising a turning region comprising a conical section which defines a conical shaped inner portion which tapers towards a suction mouth, wherein the suction channel comprises a portion which runs essentially perpendicular to said impeller axis and opens generally radially into said conical section;

characterized in that said suction channel further comprises a cylindrical channel section coupled to said conical section of the suction channel.

5. An inline centrifugal pump with a radial or semiaxial impeller, in which a rotational axis of the impeller is arranged perpendicular to a flow axis of the pump, said pump defining a suction channel comprising a turning region comprising a conical section which defines a conical shaped inner portion which tapers towards a suction mouth, wherein the suction channel comprises a portion which runs essentially perpendicular to said impeller axis and opens generally radially into said conical section;

characterized in that the suction channel defines a trapezoidal area which opens substantially radially into the conical turning region;

said channel comprising a wall and a plurality of lateral walls, said wall forming a base of the trapezoid area and lying flush with a floor of the turning region, wherein the plurality of lateral walls of the channel in a longitudinal section plane blend into the conical wall part of the turning region.

6. An inline centrifugal pump with a radial or semiaxial impeller, in which a rotational axis of the impeller is arranged perpendicular to a flow axis of the pump, said pump defining a suction channel comprising a turning region comprising a conical section which defines a conical shaped inner form which tapers towards a suction mouth, wherein the suction channel comprises a portion which runs essentially perpendicular to said impeller axis and opens generally radially into said conical section;

the suction channel defines a trapezoidal area which opens roughly radially into the conical turning region;

characterized in that said trapezoidal area is defined by a plurality of lateral walls and a floor forming the base of the trapezoidal area, wherein said plurality of lateral walls and said floor run parallel to said flow axis between the trapezoidal area and a longitudinal section plane.

7. An inline centrifugal pump with a radial or semiaxial impeller, in which a rotational axis of the impeller is arranged perpendicular to a flow axis of the pump, said pump defining a suction channel comprising a suction connection and a turning region comprising a conical section which defines a conical shaped inner form which tapers towards a suction mouth, wherein the suction channel comprises a portion which runs essentially perpendicular to said impeller axis and opens generally radially into said conical section;

characterized in that the suction channel defines a trapezoidal area which opens roughly radially into the conical turning region;

a cross sectional area of the suction channel in a region directly in front of the turning region has the following relationship to a cross sectional area of the suction channel in a region of the suction connection:

$$0.8 \leqq B/A \leqq 1.4,$$

where

B is the cross sectional area of the suction channel in the region directly in front of the turning region, and A is the cross sectional area of the suction channel in the region of the suction connection;

a largest cross sectional area of the suction channel in the turning region transverse to the impeller axis has the following relationship to a cross sectional area in a cylindrical section of the suction channel in the region directly in front of the suction mouth of the impeller:

$$0.5 \leqq \frac{\sqrt{D}}{\sqrt{C}} \leqq 0.8,$$

Where

D is the cross sectional area of the cylindrical section in the region directly in front of the suction mouth; and C is the largest cross sectional area of the suction channel in the turning region transverse to the impeller axis;

and that a height h of the turning region fulfills the following rule:

$$h \geqq h_b + r_{min},$$

where $h_b$ is a height of a suction channel portion directly in front of the turning region and $r_{min}$ is a smallest radius of curvature with which the suction channel portion blends into the turning region, and which is defined as follows:

$$r_{min} = (0.2 \text{ to } 0.5) \cdot r_a,$$

where $r_a$ is a radius of the suction channel in the region of the suction connection.

* * * * *